US008342585B1

(12) United States Patent
Cooper et al.

(10) Patent No.: US 8,342,585 B1
(45) Date of Patent: Jan. 1, 2013

(54) DRUM LIFTER

(76) Inventors: Edward L. Cooper, Clarklake, MI (US); Kevin L. Copeland, Jackson, MI (US); Steven J. Hayes, Tipton, MI (US)

( * ) Notice: Subject to any disclaimer, the term of this patent is extended or adjusted under 35 U.S.C. 154(b) by 122 days.

(21) Appl. No.: 12/621,103

(22) Filed: Nov. 18, 2009

Related U.S. Application Data

(60) Provisional application No. 61/116,060, filed on Nov. 19, 2008.

(51) Int. Cl.
*B66C 1/00* (2006.01)

(52) U.S. Cl. ..... 294/101; 294/103.1; 74/543; 74/567; 74/569

(58) Field of Classification Search ..... 294/101, 294/114, 67.3, 67.31, 81.21, 81.6, 68.3, 90, 294/103.1; 74/567–569, 543–548, 523, 528
See application file for complete search history.

(56) References Cited

U.S. PATENT DOCUMENTS 489,782 A * 1/1893 Bahret ..... 248/316.3
1,182,313 A * 5/1916 Randal et al. ..... 294/103.1
2,347,922 A * 5/1944 Nelson ..... 294/102.1
2,654,630 A * 10/1953 Renfroe ..... 294/104
3,003,806 A * 10/1961 Shramek ..... 294/101
3,008,749 A * 11/1961 Gowan ..... 294/86.4
3,510,019 A * 5/1970 Howard ..... 414/607
5,207,468 A * 5/1993 Saulnier et al. ..... 294/67.31

OTHER PUBLICATIONS

Wire Wizard FDL-C Drum Shark Drum Lifter web page from www.wire-wizard.com, Nov. 1, 2008.

* cited by examiner

*Primary Examiner* — Saul Rodriguez
*Assistant Examiner* — Gabriela Puig
(74) *Attorney, Agent, or Firm* — Mary M. Moyne; Fraser Trebilcock

(57) ABSTRACT

A drum lifter for lifting and moving empty and full chimed and unchimed drums. The lifter includes a cross member with grippers at each end. The grippers include a cam block with a cam rotatably mounted in the cam block.

24 Claims, 6 Drawing Sheets

DRUM LIFTER

CROSS REFERENCES TO RELATED APPLICATIONS

This application claims the benefit of U.S. Provisional Application No. 61/116,060, filed Nov. 19, 2008, which is hereby incorporated herein by reference in its entirety, except that the present application supersedes any portion of the above referenced provisional application which is inconsistent with the present application.

STATEMENT REGARDING FEDERALLY SPONSORED RESEARCH OR DEVELOPMENT

Not Applicable

BACKGROUND OF THE INVENTION

Field of the Invention

The present invention relates to a drum lifter for lifting a drum. In particular, the present invention relates to a drum lifter for lifting a chimed or chimless drum having a variety of diameters.

BRIEF SUMMARY OF THE INVENTION

A drum lifter for lifting and moving empty and full chimed and unchimed drums. The lifter includes a cross member with grippers at each end. The length of the cross member can be adjustable to accommodate drums having different diameters. In one (1) embodiment, each end of the cross member has a pair of grippers. In one (1) embodiment, the pair of grippers are mounted on a mounting bracket having an arcuate shape so that the grippers can be spaced apart along the circular top of the drum. The grippers may also be positionable on the mounting bracket to enable easier positioning of the grippers on the top of the drum. The grippers include a cam block with a cam rotatably mounted in the cam block. The cam block includes a front section and a back section connected together at one end in a spaced apart relationship which forms a slot between the front and back sections. The cam is rotatably mounted in a notch in the front section of the cam block. The axis of rotation of the cam is offset from the center axis of the cam so that as the cam is rotated, varying amounts of the cam extend into the slot between the front and back sections of the cam block. The cam includes a handle which allows for easily rotating the cam. The cam block includes a stop to prevent the handle of the cam from over rotating and entering the path below the entrance into the slot between the front and back sections of the cam block. The cam block also has a locking pin which prevents the handle from rotating to lock the cam in the gripping position. The second end of the back section of the cam block opposite the cam can be provided with a cam shoe which extends into the slot between the front and back sections of the cam block. The cam shoe provides the opposed surface from the cam. When the gripper is in the gripping position the drum is trapped between the outer surface of the cam and the cam shoe. The cross member is connected to a lifting mechanism which allows for lifting and moving the drum. In one (1) embodiment, the lifting mechanism is a pair of lifting arms pivotably mounted together at one end with the opposed ends of each arm pivotably mounted to opposed ends of the cross member.

The lifting arms and cross member form a triangle with the lifting point at the apex of the triangle where the lifting arms are connected together.

The present invention relates to a drum lifter for lifting a drum which comprises a cross member having opposed ends, and grippers mounted at each end of the cross member, each gripper having a cam block and a cam rotatably mounted in the cam block.

Further, the present invention relates to a drum lifter for lifting a drum which comprises a lifting mechanism configured to be connected to a lifting device, a cross member having opposed ends and connected to the lifting mechanism, and a gripper mounted at each end of the cross member.

Still further, the present invention relates to a method for lifting a drum which comprises the steps of providing a drum lifter having a cross member with opposed ends, a gripper mounted at each end of the cross member, each gripper having a cam block with a front section and a back section with a slot extending therebetween, the front section having a notch with a cam rotatably mounted in the notch, moving the grippers to an ungripped position by rotating the cam to the ungripped position so that the cam does not extend substantially into the slot between the front and back sections of the cam block, positioning the grippers on a top end of the drum so that the top end of the drum extends into the slot between the front and back sections of the cam block, moving the grippers to the gripping position by rotating the cam in a counterclockwise direction so that the cam moves into the slot between the front and back sections of the cam block and into contact with the drum, and lifting the cross member to lift the drum.

The substance and advantages of the present invention will become increasingly apparent by reference to the following drawings and the description.

DETAILED DESCRIPTION OF THE INVENTION

Figure 1:
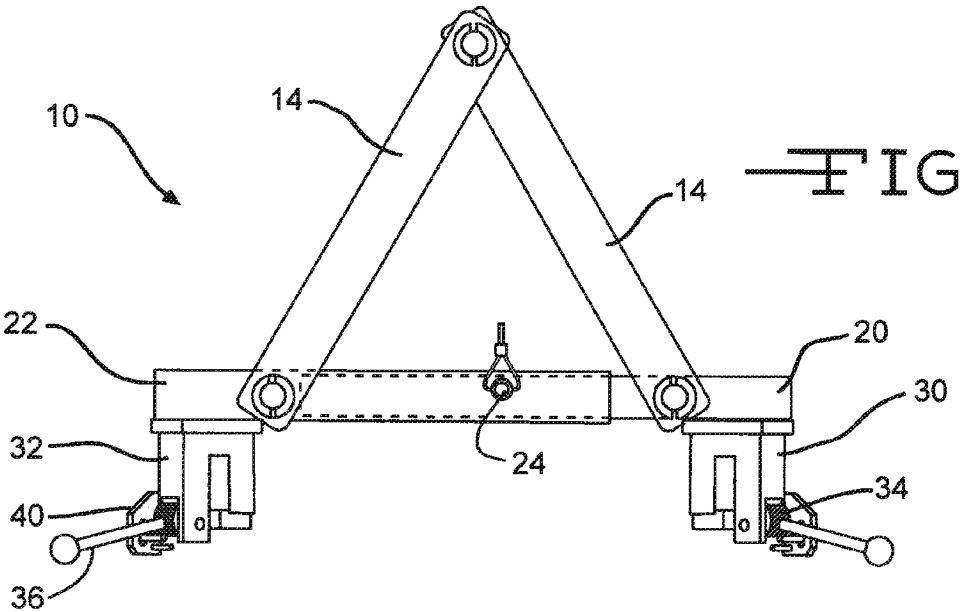
FIG. 1 is a side view of the drum lifter 10 showing the lifting arms 14, cross member 18 and grippers 30.
Figure 2:
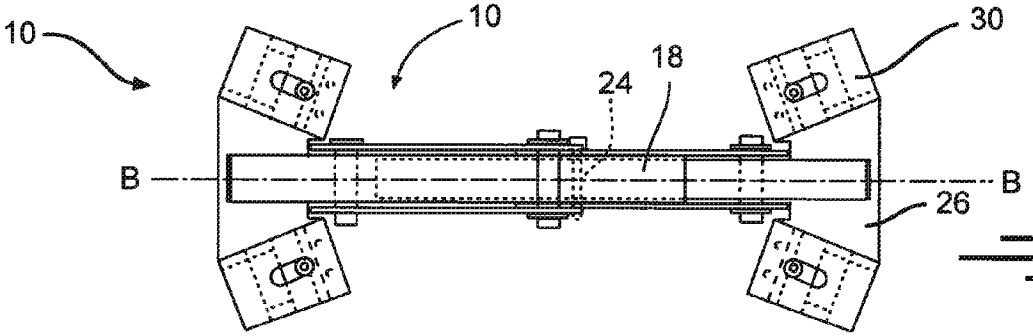
FIG. 2 is a top view of the drum lifter 10 showing the four (4) grippers 30.
Figure 3:
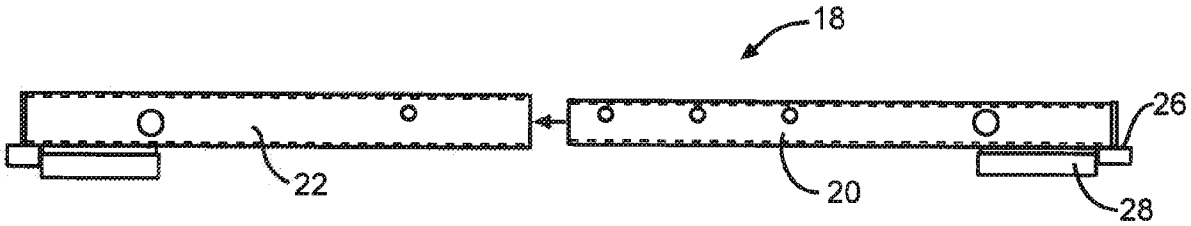
FIG. 3 is a side view of the outer tube 22 and the inner tube 20 of the cross member 18.
Figure 4:
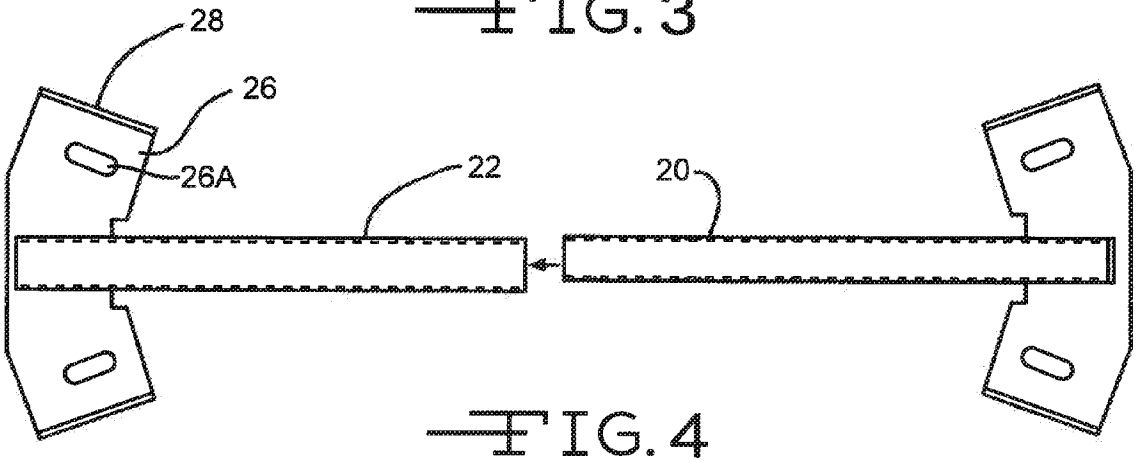
FIG. 4 is a top view of the outer tube 22 and the inner tube 20 of the cross member 18 showing the mounting brackets 26 at the ends of the inner and outer tubes 20 and 22.

FIGS. 1 and 2 show the drum lifter 10 of the present invention. The drum lifter 10 includes a cross member 18 and grippers 30. The cross member 18 has opposed ends with grippers 30 mounted at each end. In one (1) embodiment, the length of the cross member 18 between the ends is adjustable to accommodate drums 100 having different diameters. In one (1) embodiment, the cross member 18 includes an inner tube 20 telescopingly mounted in an outer tube 22. The inner tube 20 can be moved in and out of the outer tube 22 to adjust the length of the cross member 18. The inner tube 20 is provided with several holes which can be aligned with a hole in the outer tube 22 (FIG. 3). A pin 24 is provided which extends through the hole in the outer tube 22 and through one (1) of the holes in the inner tube 20 to lock the inner and outer tubes 20 and 22 in position once the cross member 18 is the correct length.

Figure 7:
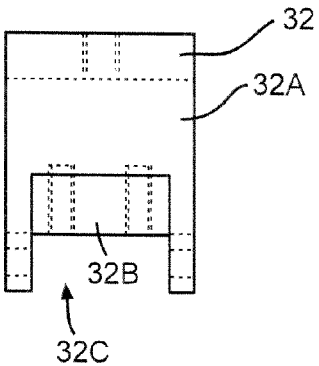
FIG. 7 is a front view of the cam block 32 of the gripper 30 showing the notch 32C in the front section 32A.

The grippers 30 include a cam block 32 and a cam 34. The cam block 32 has a front section 32A and a back section 32B having first and second ends. The first ends of the front and back sections 32A and 32B are connected together by a top wall such that a U-shaped slot 32D is formed between the spaced apart front and back sections 32A and 32B. In one (1) embodiment, the front section 32A is longer than the back section 32B such that the second end of the front section 32A extends beyond the second end of the back section 32B. The front section 32A has a notch 32C at the second end for rotatably mounting the cam 34 (FIG. 7).

Figure 5:
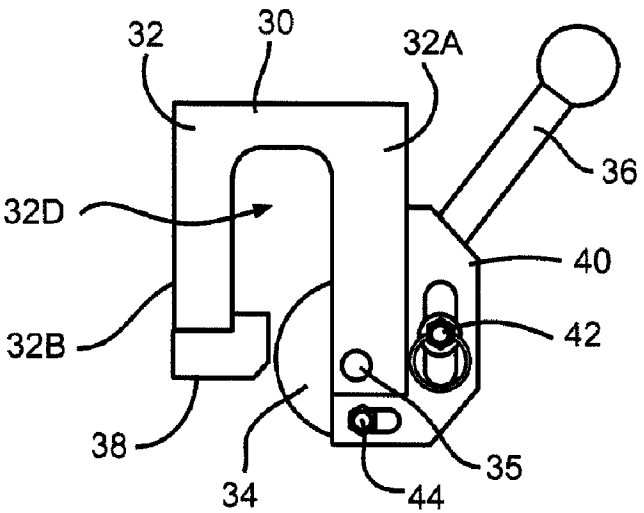
FIG. 5 is a side view of one (1) of the grippers 30 with the handle 36 in the fully up position.
Figure 9:
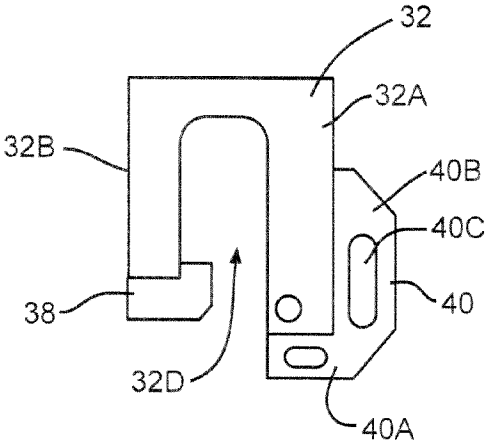
FIG. 9 is a side view of the cam block 32 without the cam 34 showing the cam shoe 38 and lock plate 40.
Figure 8:
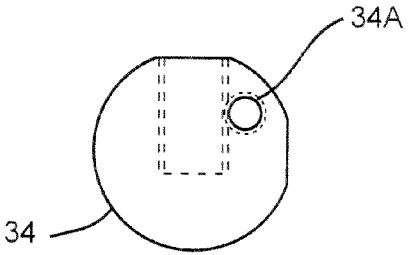
FIG. 8 is a side view of the cam 34 without the handle 36 showing the offset mounting hole 34A for the pin 35.
Figure 10:
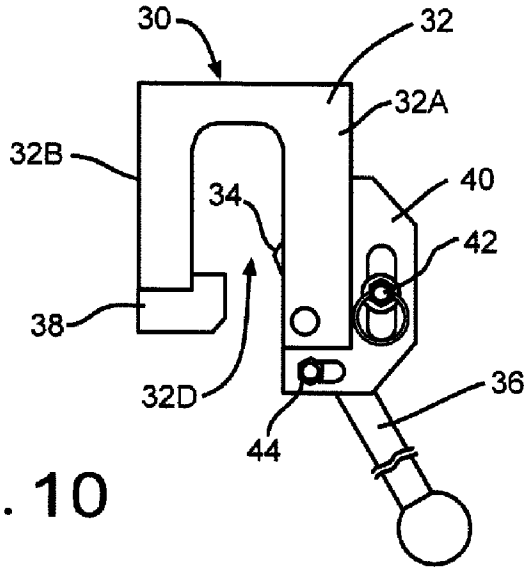
FIG. 10 is a side view of the cam block 32 showing the cam 34 in the ungripped position.
Figure 12:
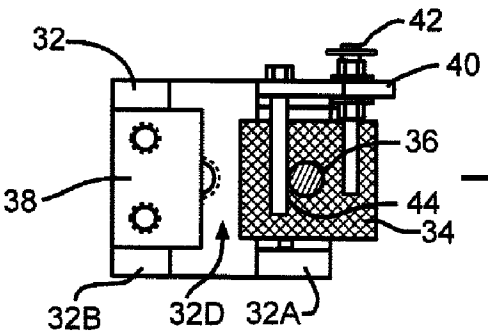
FIG. 12 is a bottom view of the cam block 32 showing the cam 34 in the ungripped position.

The cam 34 is mounted in the notch 32C in the front section 32A of the cam block 32 so that the cam 34 can rotate or pivot in the notch 32C in the front section 32A of the cam block 32. In one (1) embodiment, the cam 34 is mounted by a pair of pins 35 which extend through each side of the front section 32A of the cam block 32 and into each end of the cam 34. In another embodiment, a single pin extends completely through the cam 34 and through the sides of the front section 32A adjacent the notch 32C. The cam 34 has an essentially cylindrical shape. The mounting hole 34A for mounting the cam 34 is offset from the center axis of the cam 34 so that the axis of rotation A-A of the cam 34 is offset from the center axis of the cam 34. A handle 36 is mounted on the side of the cam 34 spaced between the ends and extends outward in a direction substantially opposite the back section 32B of the cam block 32. The handle 36 allows for rotating the cam 34 from the open, ungripped position to the gripping position. In one (1) embodiment, when the cam 34 is in the open, ungripped position, the cam 34 does not extend beyond the front section 32A into the slot 32D between the front section 32A and the back section 32B of the cam block 32. In one (1) embodiment when the cam 34 is in the open, ungripped position, the cam 34 extends slightly into the slot 32D between the front and back sections 32A and 32B of the cam block 32 (FIG. 10). In one (1) embodiment when the handle 36 is in the fully up position, the cam 34 extends into the slot 32D and substantially extends to the back section 32B or the cam shoe 38 (FIG. 5). In one (1) embodiment, the cam 34 does not contact the back section 32B or the cam shoe 38 in any position. In one (1) embodiment, a section of the side of the cam 34 is flat (FIG. 8). In one (1) embodiment, the outer surface of the cam 34 is knurled. In one (1) embodiment, the flat section of the outer surface of the cam 34 is smooth and is not knurled.

Figure 11:
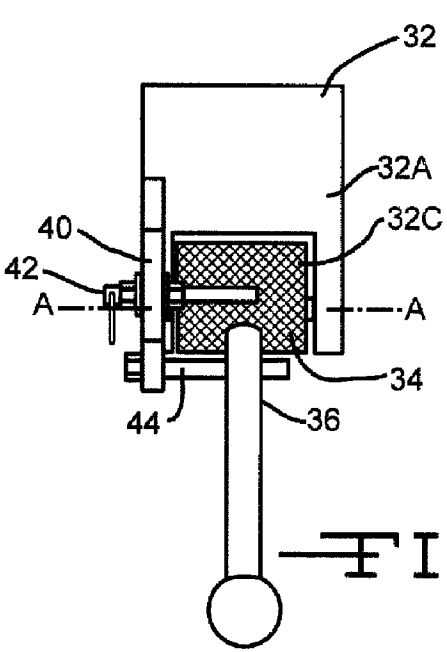
FIG. 11 is a front view of the cam block 32 showing the cam 34 in the ungripped position.
Figure 13:
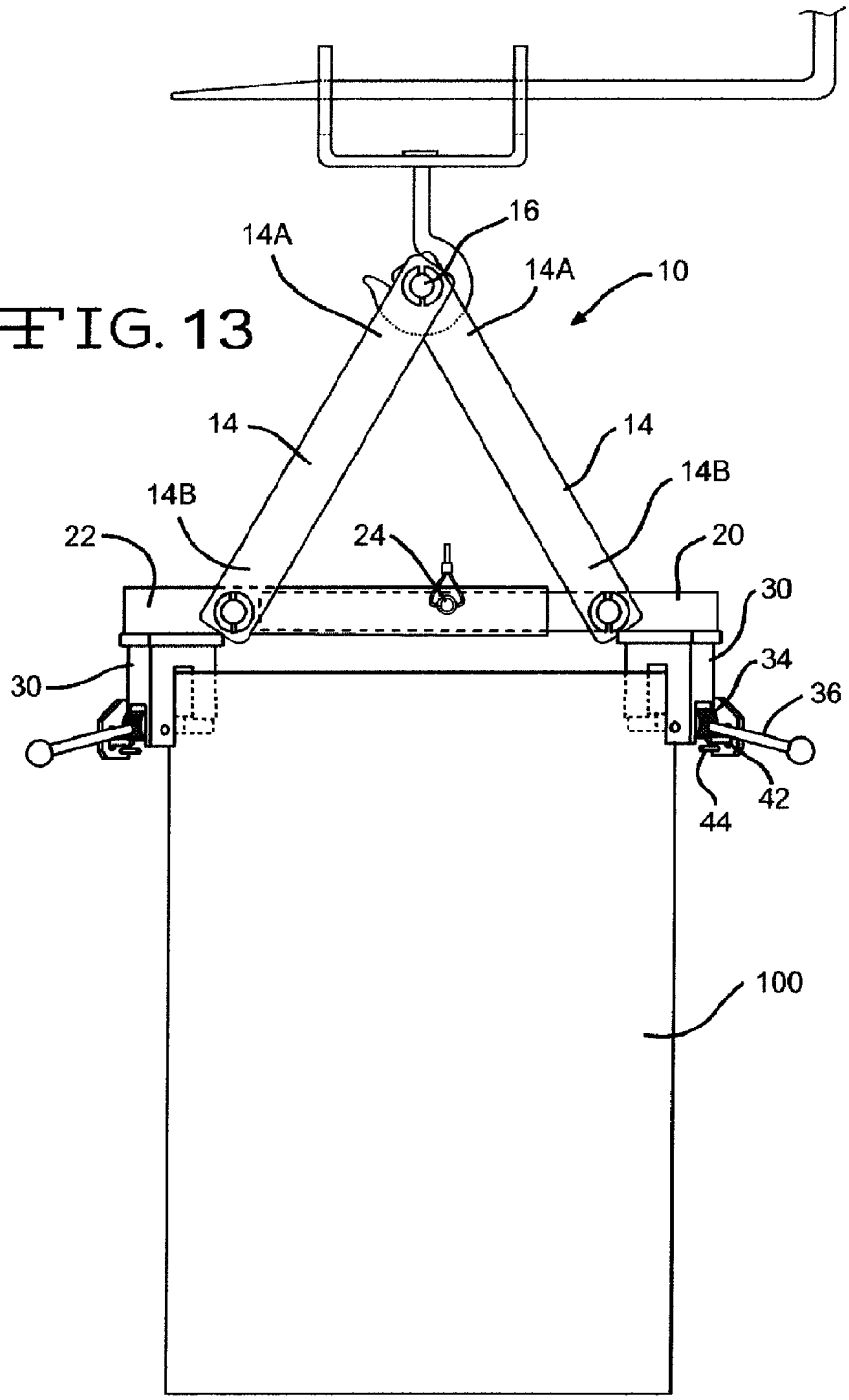
FIG. 13 is a side view of the drum lifter 10 attached to a drum 100.

A lock plate 40 is mounted to the front section 32A of the cam block 32. The lock plate 40 is mounted on one (1) side of the front section 32A. In one (1) embodiment, the lock plate 40 is mounted on the outer side of the cam block 32 opposite the cross member 18. The position of the lock plate 40 on the outer side of the cam block 32 allows for easier access to the locking pin 42 by the user. In one (1) embodiment, the lock plate 40 includes a stop portion 40A and a lock portion 40B. In one (1) embodiment, the stop portion 40A and the lock portion 40B are a unitary piece. In another embodiment, the stop portion 40A is separate from the lock portion 40B. The stop portion 40A extends along the second end of the front section 32A of the cam block 32 on either the right or left side of the notch 32C. The stop portion 40A includes a stop 44. The stop 44 extends into the area below the notch 32C in the front section 32A of the cam block 32 (FIG. 11). The stop 44 prevents the handle 36 of the cam 34 from rotating beyond the vertical position so that the handle 36 does not block the path to the slot 32D between the front and back sections 32A and 32B of the cam block 32. It is understood that the stop 44 can be mounted to the cam block 32 in a variety of ways. In one (1) embodiment, the stop 44 is a pin which extends across the notch 32C. The lock portion 40B extends along the front side of the front section 32A adjacent the notch 32C and opposite the back section 32B. The lock portion 40B extends along either the right or left side of the notch 32C. The lock portion 40B has a slot 40C for mounting a retractable, locking pin 42. In the extended or locked position, the locking pin 42 extends in front of the notch 32C and prevents the handle 36 of the cam 34 from rotating downward so that the cam 34 remains in the gripping position (FIG. 13). When the gripper 30 is not in use, the retractable locking pin 42 is retracted so that the handle 36 can move downward and the cam 34 can freely move into the open, ungripped position (FIG. 10). In one (1) embodiment, the locking pin 42 is spaced in front of the notch 32C in the front section 32A so that if the locking pin 42 is in the locked position and the cam 34 is moved into the ungripped position, the locking pin 42 does not contact the cam 34 or interfere with the rotation of the cam 34.

In one (1) embodiment, a cam shoe 38 is mounted on the second end of the back section 32B of the cam block 32 and extends into the slot 32D between the front and back sections 32A and 32B of the cam block 32. In one (1) embodiment, the cam shoe 38 is removably mounted to the back section 32B so that the cam shoe 38 can be easily replaced due to wear or damage. The use of a cam shoe 38 reduces the need to replace the entire gripper 30 due to wear or damage.

The grippers 30 are connected to the cross member 18 by a mounting plate 26. The grippers 30 are mounted on the bottom side of the mounting plate 26 opposite the cross member 18. The top wall of the cam block 32 is mounted to the mounting plate 26 such that the front section 32A and back section 32B of the cam block 32 extend out from the mounting plate 26 in a direction opposite the cross member 18. In one (1) embodiment, a pair of grippers 30 are mounted at each end of the cross member 18 so that the drum lifter 10 includes four (4) grippers 30. In one (1) embodiment, the mounting plate 26 is provided with a pair of mounting slots 26A. One (1) mounting slot 26A is located on each side of the cross member 18. The mounting slots 26A allow for mounting the grippers 30 to the mounting plate 26. In one (1) embodiment, the grippers 30 are mounted by bolts which extend through the mounting slots 26A and into the top wall of the cam block 32. The elongate opening of the mounting slots 26A allows the position of the grippers 30 on the mounting plate 26 to be adjusted. It is understood that other means of fastening the grippers 30 to the mounting plate 26 can also be used. In one (1) embodiment, the grippers 30 are moveably mounted to the mounting plate 26 so that the grippers 30 float and move on the mounting plate 26 which allows for easier positioning of the slots 32D of the cam blocks 32 of the grippers 30 on the drum 100. In one (1) embodiment, the mounting plate 26 is provided with flanges 28 on the outer edges adjacent the grippers 30 (FIG. 3). The flanges 28 extend outward adjacent the grippers 30 and prevent the grippers 30 from over rotating on the mounting plate 26. In one (1) embodiment, each pair of grippers 30 has a left side gripper 30 and a right side gripper 30. The mounting plate 26 has an angled shape so that the left and right side grippers 30 are mounted in an arc at each end of the cross member 18. The mounting of the grippers 30 at an angle to the cross member 18 enables the slot 32D between the front and back sections 32A and 32B of the cam block 32 to be at an angle to the longitudinal axis B-B of the cross member 18 so that the grippers 30 can be mounted on the circular top of the drum 100. In one (1) embodiment, all the grippers 30 are identical. In one (1) embodiment, the left side gripper and the right side gripper 30 are identical except for the positioning of the lock plate 40 on the cam block 32. In one (1) embodiment, for the gripper 30 mounted on the left side of the cross member 18, when viewed from the front of the gripper 30, the lock plate 40 is mounted on the left side of the cam block 32. In one (1) embodiment, for the gripper 30 mounted on the right side of the cross member 18 when viewed from the front of the gripper 30, the lock plate 40 is mounted on the right side of the cam block 32.

In one (1) embodiment, the cross member 18 is connected to a lifting attachment. In one (1) embodiment, the lifting attachment is a pair of lifting arms 14. The lifting arms 14 have first and second ends 14A and 14B and are pivotably connected together at the first ends 14A. In one (1) embodiment, the first ends 14A of the lifting arms 14 are connected together by a pin 16. The pin 16 can also allow for connecting a hook or other attachment mechanism to the lifting attachment to allow for lifting the drum 100 (FIG. 13). In one (1) embodiment, a fork lift adapter is provided. The fork lift adapter has a hook at one (1) end for connecting to the lifting arms 14 and a bracket attached to the hook which is slid onto a single fork of the fork lift. It is understood that other bracket mechanisms and lifting devices can be connected to the lifting attachment to lift the drum 100. The second end 14B of each lifting arm 14 is connected adjacent opposite ends of the cross member 18 so that the lifting arms 14 and cross member 18 form a triangle with the intersection of the two (2) lifting arms 14 forming the apex of the triangle (FIG. 1). The second ends 14B of the lifting arms 14 are pivotably connected to the cross member 18. The second end 14B of the lifting arms 14 are connected to the cross member 18 so that one (1) lifting arm 14 is connected to the inner tube 20 and one (1) lifting arm 14 is connected to the outer tube 22. The pivotable connection of the first ends 14A of the lifting arms 14 and the pivotable connection of the second ends 14B of the lifting arms 14 to the inner and outer tubes 20 and 22 allows the lifting arms 14 to pivot to accommodate different lengths of the cross member 18.

The drum lifter 10 allows a user to easily lift and move a heavy drum 100. The drum lifter 10 enables a user to lift a chimed or unchimed drum 100. The drum lifter 10 can be used with a variety of types of drums 100 having a variety of diameters and a variety of wall thicknesses. The drum lifter 10 can be used to lift a variety of different types of drums 100 constructed of different types of materials. The drum lifter 10 can be used to lift drums 100 constructed of metal, plastic, fiberboard, and any other material well known for constructing drums 100. The drum lifter 10 is intended to mount to the top of a chimed or unchimed drum 100 to enable lifting of the drum 100. An attachment mechanism enables the drum lifter 10 to be connected to a fork lift to enable a fork lift to lift and move the drum 100.

Figure 6:
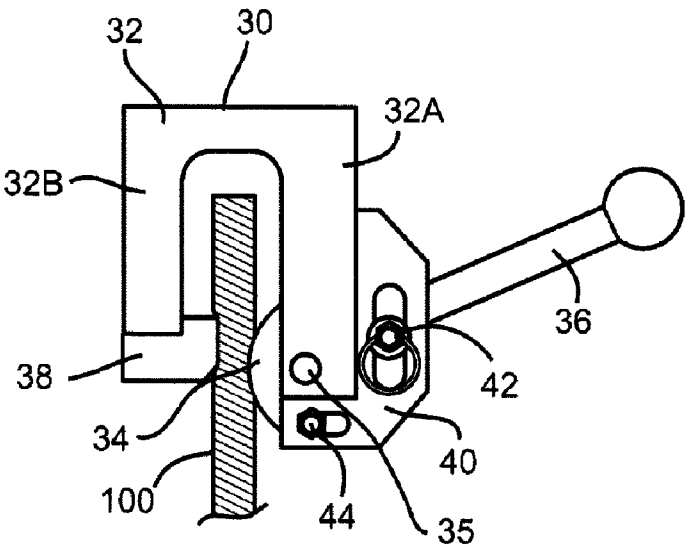
FIG. 6 is a side view of one (1) of the grippers 30 with the handle 36 and cam 34 in the gripping position.

To lift the drum 100, the drum lifter 10 is mounted on the top of the drum 100. To connect the drum lifter 10 to the drum 100, the pin 24 locking the inner and outer tubes 20 and 22 of the cross member 18 together is released so that the inner and outer tubes 20 and 22 can be moved together or apart to adjust the length of the cross member 18. The cross member 18 is adjusted so that the cross member 18 spans the distance across the top of the drum 100 so that the grippers 30 are adjacent the sides of the drum 100. Once the cross member 18 is the correct length, the pin 24 is reinserted through the inner and outer tubes 20 and 22 to lock the cross member 18 at the correct length. In one (1) embodiment, the drums 100 have standard diameters and the cross member 18 has set lengths at which the cross member 18 can be locked. Next, the grippers 30 are moved to the ungripped position. In the ungripped position, the handle 36 of the cam 34 is adjacent the stop 44 and is substantially vertical or extending straight down. In one (1) embodiment, when the cam 34 is in the ungripped position, the flat section of the outer surface of the cam 34 is in or adjacent to the u-shaped slot 32D spaced across from the cam shoe 38 to allow for easier positioning of the gripper 30 on the drum 100 (FIG. 10). In one (1) embodiment, when the locking pin 42 for the handle 36 is retracted, the handle 36 automatically moves to the ungripped position due to gravity. Once the grippers 30 are in the open, ungripped position, the drum lifter 10 is positioned on the top of the drum 100 so that the sides of the drum 100 are positioned in the slot 32D between the front and back sections 32A and 32B of the cam block 32 of each gripper 30. If the grippers 30 are not in the open, ungripped position, contact of the drum 100 with the outer surface of the cam 34 will rotate the cam 34 out of the slot 32D and allow the drum 100 to enter the slot 32D provided the locking pin 42 is in the unlocked, retracted position. The ability of the grippers 30 to be moved on the mounting plates 26 allows for positioning each of the grippers 30 on the drum 100. The movable mounting of the grippers 30 on the mounting plate 26 enables the grippers 30 to be moved and rotated so that the top or side of the drum 100 is aligned with the slot 32D for each of the grippers 30. The arc-shape of the mounting plates 26 allows the grippers 30 to be attached to the sides or top of the drum at four (4) points with two (2) grippers 30 on each end of the cross member 18 spaced apart on each end of the cross member 18. The use of four (4) grippers 30 and the positioning and spacing of the grippers 30 provides stability when lifting the drum 100. The grippers 30 also evenly distribute the weight of the drum 100 on each end and on each side of the cross member 18. Once the grippers 30 are positioned on the top of the drum 100, the cams 34 are rotated to engage the sides of the drum 100 and to secure the sides of the drum 100 in the grippers 30. The cams 34 of each gripper 30 can be rotated separately or simultaneously. In one (1) embodiment, the cams 34 are rotated in the counterclockwise direction when the cams 34 are moved from the open, ungripped position to the gripping position. In one (1) embodiment, the locking pin 42 remains in the retracted position when the cam 34 is in the ungripped position. Once the locking pin 42 is in the unlocked, retracted position, the handle 36 is moved upward toward the cross member 18 to rotate the cam 34 into the slot 32D between the front and back sections 32A and 32B of the cam block 32. As the cam 34 is rotated, the cam 34 contacts and secures the side of the drum 100 between the outer surface of the cam 34 and the back section 32B of the cam block 32 or cam shoe 38, if present. The side of the drum 100 is compressed between the outer surface of the cam 34 and the back section 32B of the cam block 32 or the cam shoe 38. The offset axis of rotation A-A of the cam 34 enables varying amounts of the cam 34 to be moved into the slot 32D as the cam 34 is rotated. Thus, the distance between the outer surface of the cam 34 and the back section 32B or cam shoe 38 varies to enable the grippers 30 to grip drums 100 having variable thickness. The knurled surface of the cam 34 helps the cam 34 to grip the surface of the drum 100 and hold the drum 100 in place and prevents the drum 100 from slipping in the gripper 30. In one (1) embodiment, when the cam 34 is in the gripping position, the side of the drum 100 is trapped between a top edge of the cam shoe 38 and the cam 34 which secures the drum 100 in the gripper 30 (FIG. 6). In one (1) embodiment, the diameter of the cam 34 is selected so that the outer surface of the cam 34 almost contacts the back section 32B of the cam block 32 or the cam shoe 38 when the handle 36 is fully lifted. This allows for gripping drums 100 having very thin walls. The handle 36 is moved upward until the handle 36 moves past the locking pin 42. The locking pin 42 is then released and moved back into the locking position. Once in position, the locking pin 42 prevents the handle 36 from moving downward into the ungripped position. The locking pin 42 moves across the notch 32C in the front section 32A of the cam block 32 and prevents the handle 36 from rotating into the ungripped position. In one (1) embodiment, the position of the locking pin 42 on the lock portion 40B of the lock plate 40 is adjustable so that the handle 36 can be locked in different positions to accommodate drums 100 having different thicknesses.

Once all of the cams 34 of the grippers 30 are in the gripping position and the locking pins 42 are in the locked position, the drum lifter 10 can be used to lift the drum 100. As the drum lifter 10 is moved upward, the weight of the drum 100 tries to pull the drum 100 downward and out of the gripper 30. However, as the drum 100 moves downward, the sides of the drum 100 try to rotate the cam 34 in the counter-clockwise direction which moves the cam 34 further into the slot 32D between the front and back sections 32A and 32B of the cam block 32 and into greater contact with the side of the drum 100 which further tightens the grip of the grippers 30 on the drum 100. If the drum 100 is moved upward in the slot 32D in the cam block 32, the cam 34 rotates and the handle 36 contacts the locking pin 42 which prevents the cam 34 from rotating to an ungripped position.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated by reference herein in their entirety, with each claim standing on its own as a separate embodiment of the present invention.

It is intended that the foregoing description be only illustrative of the present invention and that the present invention be limited only by the hereinafter appended claims.

We claim:

1. A drum lifter for lifting a drum which comprises:

a) a cross member having opposed ends;

b) grippers mounted at each end of the cross member, each gripper having a cam block with front and back sections having first and second ends and connected together at the first end and having a slot between the front and back sections, the front section having a notch adjacent the second end and a cam rotatably mounted in the notch;

c) a handle mounted on the cam; and d) a stop mounted adjacent the second end of the first section of the cam block and extending at least partially across the notch.

2. The drum lifter of claim 1 wherein at least two (2) grippers are mounted at each end of the cross member.

3. The drum lifter of claim 1 wherein a length of the front section between the ends is greater than a length of the back section between the ends and wherein the cam is mounted in the notch so that a portion of the cam extends below the second end of the back section in a direction opposite the first end of the front section.

4. The drum lifter of claim 3 wherein a cam shoe is provided on the second end of the back section and extends into the slot between the front and back sections of the cam block.

5. The drum lifter of claim 1 wherein the handle extends outward from the notch in the front section of the cam block in a direction substantially opposite the back section of the cam block.

6. The drum lifter of claim 1 wherein a locking pin is mounted adjacent a side of the front section of the cam block opposite the back section, wherein in use, in an unretracted position, the locking pin extends at least partially across the notch.

7. The drum lifter of claim 1 wherein the cam has a substantially cylindrical shape and is rotatably mounted so that an axis of rotation of the cam is offset from a center axis of the cam.

8. The drum lifter of claim 1 wherein a side of the cam has a flat section.

9. The drum lifter of claim 8 wherein the flat section is located on the side of the cam so that when the cam is in an open, ungripped position, the flat section is adjacent and in the slot of the cam block.

10. The drum lifter of claim 1 wherein the handle extends outward from the cam in a direction perpendicular to an axis of rotation of the cam.

11. The drum lifter of claim 1 wherein the notch has opposed sides, wherein the cam has opposed ends with a side extending therebetween, wherein the cam is mounted in the notch so that the ends of the cam are adjacent the sides of the notch and wherein the handle is mounted on the side of the cam spaced between the ends of the cam.

12. A drum lifter for lifting a drum which comprises:

a) a cross member having opposed ends;

b) grippers mounted at each end of the cross member, each gripper having a cam block with front and back sections having first and second ends and connected together at the first end and having a slot between the front and back sections, the front section having a notch adjacent the second end and a cam rotatably mounted in the notch;

c) a handle mounted on the cam; and d) a locking pin mounted adjacent a side of the front section of the can block opposite the back section, wherein in use, in an unretracted position, the locking pin extends at least partially across the notch.

13. The drum lifter of claim 12 wherein the handle extends outward from the notch in the front section of the cam block in a direction substantially opposite the back section of the cam block.

14. The drum lifter of claim 12 wherein a stop is mounted adjacent the second end of the first section of the cam block and extends at least partially across the notch.

15. The drum lifter of claim 12 wherein a length of the front section between the ends is greater than a length of the back section between the ends and wherein the cam is mounted in the notch so that a portion of the cam extends below the second end of the back section in a direction opposite the first end of the front section.

16. The drum lifter of claim 15 wherein a cam shoe is provided on the second end of the back section and extends into the slot between the front and back sections of the cam block.

17. The drum lifter of claim 12 wherein the cam has a substantially cylindrical shape.

18. The drum lifter of claim 12 wherein the cam has a flat section located on the side of the cam so that when the cam is in an open, ungripped position, the flat section is adjacent and in the slot of the cam block.

19. The drum lifter of claim 12 wherein the handle extends outward from the cam in a direction perpendicular to an axis of rotation of the cam.

20. The drum lifter of claim 12 wherein the notch has opposed sides, wherein the cam has opposed ends with a side extending therebetween, wherein the cam is mounted in the notch so that the ends of the cam are adjacent the sides of the notch and wherein the handle is mounted on the side of the cam spaced between the ends of the cam.

21. A method for lifting a drum which comprises the steps of:

a) providing a drum lifter having a cross member with opposed ends, a gripper mounted at each end of the cross member, each gripper having a cam block with a front section and a back section with a slot extending therebetween, the front section having a notch with a cam rotatably mounted in the notch, a handle mounted on the cam and extending outward from the first section of the cam block in a direction substantially opposite the back section, and a locking pin provided adjacent the notch, b) moving the grippers to an ungripped position by rotating the cam to the ungripped position so that the cam does not extend substantially into the slot between the front and back sections of the cam block;

c) positioning the grippers on a top end of the drum so that the top end of the drum extends into the slot between the front and back sections of the cam block;

d) moving the grippers to the gripping position by rotating the cam in a counterclockwise direction so that the cam moves into the slot between the front and back sections of the cam block and into contact with the drum;

e) moving the locking pin into a locked position;

f) releasing the handle so that the handle contacts the locking pin to hold the grippers in the gripping position; and g) lifting the cross member to lift the drum.

22. The method of claim 21 wherein further in step (g), when the cross member is lifted, a weight of the drum moves the drum downward in a direction out of the slot between the front and back sections of the cam block, and wherein the contact of the drum with the cam tends to rotate the cam in the counterclockwise direction which moves the cam further into the slot and tightens a grip on the drum.

23. The method of claim 21 wherein further in step (c), when the drum is moved into the slot between the front and back sections of the cam block, the drum contacts the cam and rotates the cam in the clockwise direction so that the cam is rotated out of the slot to allow the drum to enter the slot.

24. A method for lifting a drum which comprises the steps of:

a) providing a drum lifter having a cross member with opposed ends, a gripper mounted at each end of the cross member, each gripper having a cam block with a front section and a back section with a slot extending therebetween, the front section having a notch with a cam rotatably mounted in the notch, a handle mounted on the cam and a stop mounted adjacent the first section of the cam block and extending at least partially across the notch;

b) moving the grippers to an ungripped position by rotating the cam to the ungripped position so that the cam does not extend substantially into the slot between the front and back sections of the cam block and so that the handle contacts the stop to prevent the handle from extending into an area below the slot;

c) positioning the grippers on a top end of the drum so that the top end of the drum extends into the slot between the front and back sections of the cam block;

d) moving the grippers to the gripping position by rotating the cam in a counterclockwise direction so that the cam moves into the slot between the front and back sections of the cam block and into contact with the drum; and e) lifting the cross member to lift the drum.

* * * * *